United States Patent [19]

Nakamura et al.

[11] Patent Number: 4,905,326

[45] Date of Patent: Mar. 6, 1990

[54] DIVING POOL

[75] Inventors: Tatsuro Nakamura, Kanagawa; Hideaki Baba; Tadashi Yoshida, both of Tokyo, all of Japan

[73] Assignee: Kajima Corporation, Tokyo, Japan

[21] Appl. No.: 273,424

[22] Filed: Nov. 18, 1988

[30] Foreign Application Priority Data

Apr. 14, 1988 [JP] Japan ..... 63-92571
Apr. 14, 1988 [JP] Japan ..... 63-92570
Apr. 14, 1988 [JP] Japan ..... 63-92569

[51] Int. Cl.[4] ..... E04H 3/18

[52] U.S. Cl. ..... 4/488; 52/169.7; 272/1 B

[58] Field of Search ..... 4/488, 489, 494, 506, 4/513, 491; 272/1 B, 3, 32; 52/169.7

[56] References Cited

U.S. PATENT DOCUMENTS 1,572,463 2/1926 Bintz ..... 4/488 X
1,664,140 3/1928 Tucker ..... 4/489
1,979,623 11/1934 Hunter ..... 4/494
3,915,450 10/1975 Flewwelling et al. ..... 272/1 B

FOREIGN PATENT DOCUMENTS 2358920 6/1975 Fed. Rep. of Germany ..... 4/489
2910999 9/1980 Fed. Rep. of Germany ..... 4/489
471805 7/1914 France ..... 272/32

*Primary Examiner*—Charles E. Phillips
*Attorney, Agent, or Firm*—Koda & Androlia

[57] ABSTRACT

A diving pool allowing scuba diving to be easily and safely enjoyed, which comprises a pool bottom progressively becoming deeper from its periphery towards its center, a tower constructed on the pool bottom at a central deepest area and rising to a level above the pool surface, an artificial island formed at a level of the pool surface around the tower, and a deck above the level of the pool surface around the tower; wherein the diving pool can be further equipped, if desired, with a water stream generator adapted to generate a water stream and a wave generator adapted to generate waves in the pool.

4 Claims, 8 Drawing Sheets

DIVING POOL

FIELD OF THE INVENTION

The present invention relates to a diving pool, more particularly to such diving pool as one of new urban type leisure facilities.

BACKGROUND OF THE INVENTION

Sea remains a world still unknown for us and we always look for peace of mind and some excitement.

There is none of facilities permitting this attractive new world to be easily and safely enjoyed by us.

Recently, scuba diving has become more and more popular and a population of divers has correspondingly increased. However, all of the existing urban pools for scuba diving are as small as of several meters in both width and depth and are utilized only for basic training of the scuba diving.

Such existing diving pools have no factor of amusement incorporated in the pools themselves and are inappropriate as the leisure facilities.

Certainly many attractive spots at which the diving truly as a leisure can be fully enjoyed can be found so far as the divers visit Okinawa and the foreign countries, but traveling expenses to visit such spots are heavy burden on urbanites. The number of spots that can be found within easy reach for the urbanites is too limited, particularly in our country, to accommodate the population of the divers recently increasing more and more.

OBJECT OF THE INVENTION

This invention has been made in view of the foregoing problems, and a primary object of the invention is to provide a diving pool as one of urban type leisure facilities, allowing scuba diving to be easily and safely enjoyed with a sporty senses.

Another object of the invention is to provide a diving pool artificially reproducing same phenomena as those occurring in the ocean so that divers may have same experiences as in the ocean.

SUMMARY OF THE INVENTION

The diving pool of the present invention has the longest linear distance extending over several tens of meters and comprises a pool bottom progressively becoming deeper from its periphery towards its center, a tower constructed on the pool bottom at a central deepest area and rising to a level above the pool surface, said tower defining therein a space within which persons can move, an artificial island formed at a level of the pool surface around the tower, and a deck formed above the level of the pool surface around the tower and having a sufficient width for persons to walk thereon.

The diving pool of the present invention can be further equipped, if desired, with a water stream generator adapted to generate the water stream and a wave generator adapted to generate waves in the pool.

According to the present invention, the pool has a diameter as large as of several tens of meters, providing a sufficient swimming space for the divers to be fully satisfied with an attractive underwater world.

Additionally, the pool of the invention progressively becomes deeper fromm its periphery towards its center so that the veteran divers may enjoy diving at the central deep area while the beginning divers may enoy diving at the shallower area. At the shallowest peripheral area of the pool, bathing without use of any diving implement is also possible.

The interior of the centrally rising tower can be utilized to provide various facilities such as a diver watching room and a diving observation room. The artificial island serves as a resting place of the divers and the deck can be utilized in the same manner as the pool side as a place for resting, observation and admiration.

When a pseudo-tidal current is generated in the pool by the water stream generator and at the same time waves are generated in the pool by the wave generator, the phenomena which may occur in ocean are artificially reproduced, enabling the divers to be satisfied with diving in an environment just as encountered in the ocean.

DETAILED DESCRIPTION OF THE INVENTION:

The details of the diving pool according to this invention will be described by referring to the attached drawings.

Figure 1:
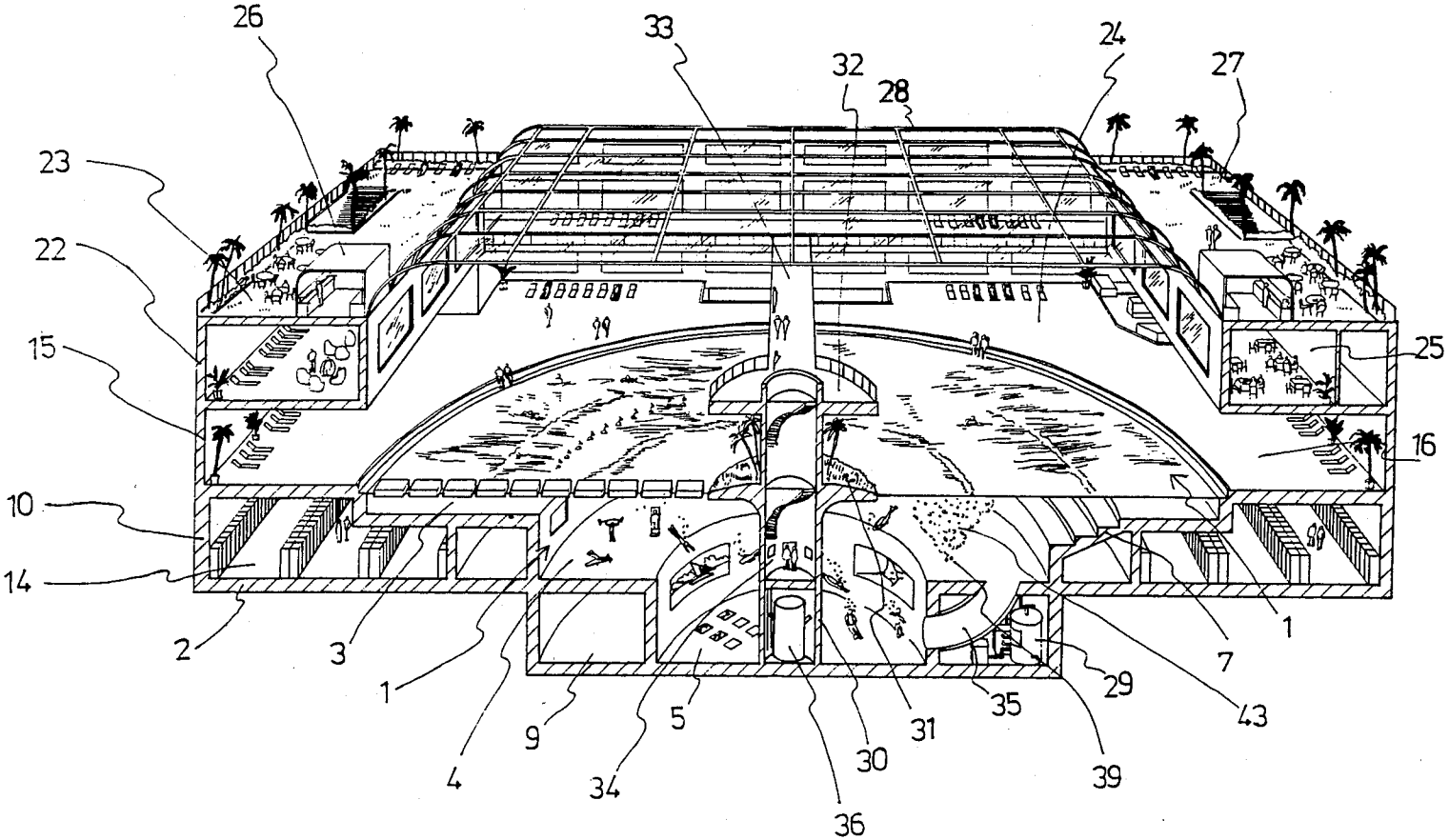
FIG. 1 is a perspective view showing, as partially broken away, an embodiment of the diving pool constructed in accordance with the present invention.

Referring to FIG. 1 showing in a partial broken perspective view an embodiment of the diving pool constructed in accordance with the invention, reference numeral 1 designates a circular pool having the longest linear distance (i.e., the maximum diameter) of 50 m.

Figure 2:
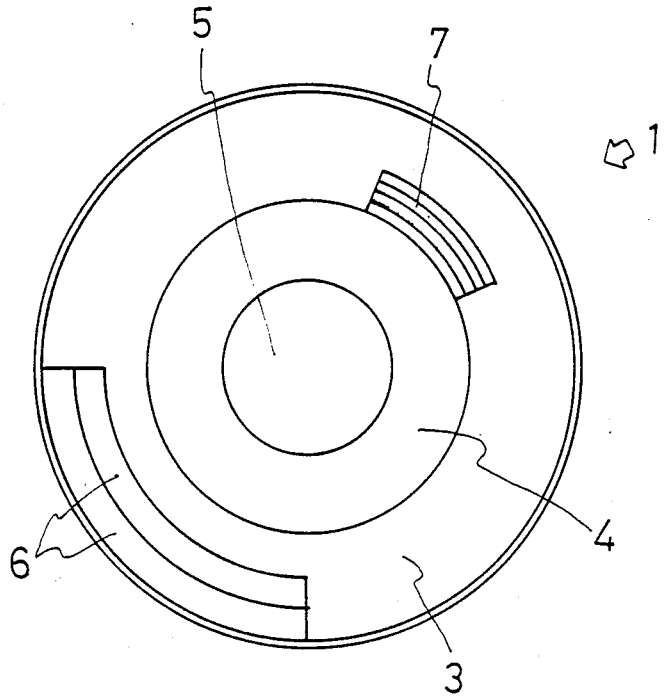
FIG. 2 is a plan view of said pool.
Figure 3:
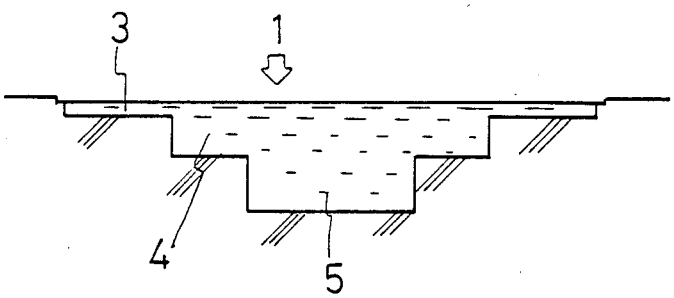
FIG. 3 is a schematic sectional view of said pool.
Figure 4:
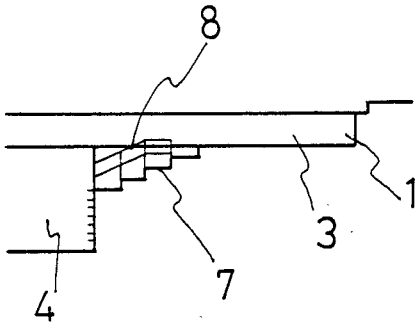
FIG. 4 is a fragmentary sectional view of said pool.
Figure 5:
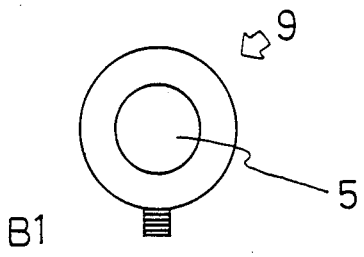
FIG. 5 is a plan view showing a first basement of large-sized concrete structure accommodating therein the diving pool.
Figure 6:
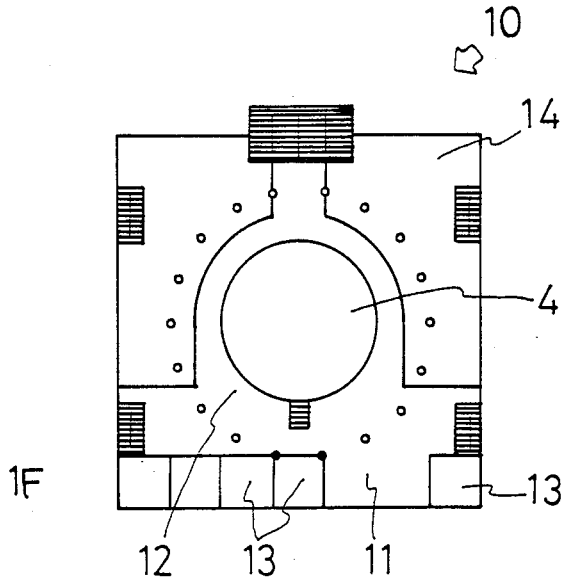
FIG. 6 is a plan view showing a first floor of said concrete structure.
Figure 7:
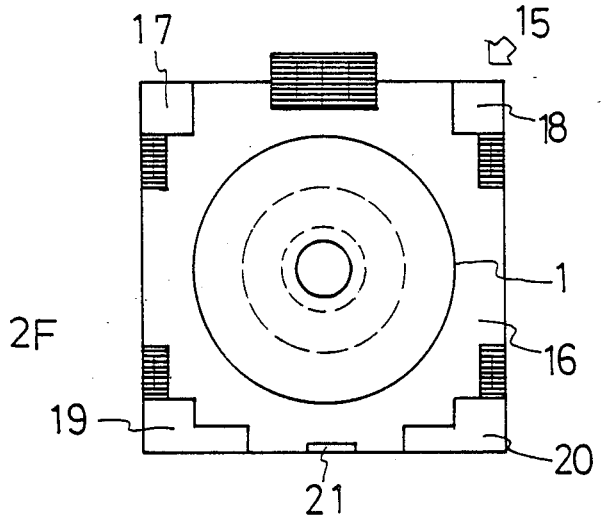
FIG. 7 is a plan view showing a second floor of said concretre structure.
Figure 8:
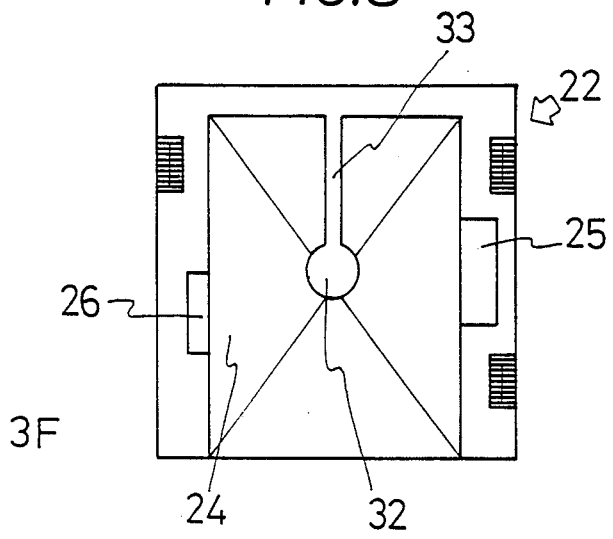
FIG. 8 is a plan view showing a third floor of said concrete structure.
Figure 9:
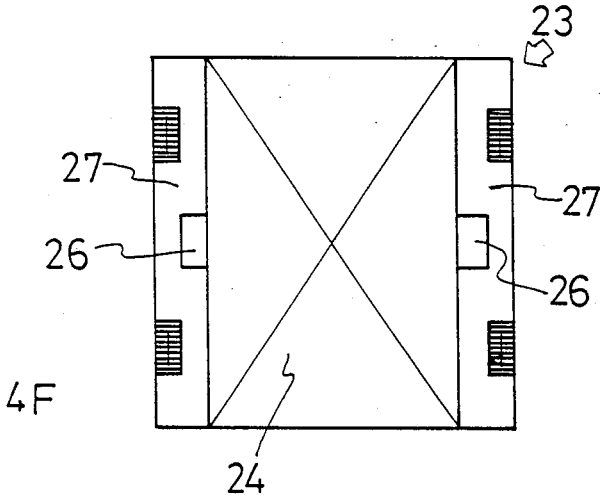
FIG. 9 is a plan view showing a fourth floor of said concrete structure.
Figure 10:
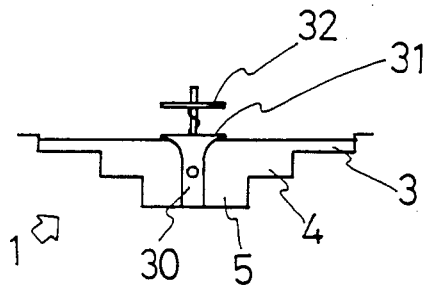
FIG. 10 is a diagram illustrating a relationship between the pool and a tower.

Said pool 1 is constructed centrally within a large-sized concrete structure 2 such as a four floor building and concentrically becomes deeper in three steps towards a center thereof, as seen in FIGS. 2 and 3. Specifically, a peripheral step defines a bathing area 3 having a depth in order of 1.2 m, a second step defines an intermediate shelf area 4 having a depth in order of 5 m and a central third step defines the deepest area having a depth in order of 10 m.

Said bathing area 3 is partially provided with a stairs-like shallow area 6 consisting of two stairs having depths in order of 0.4 m and 0.8 m, respectively, each of them being in the form of circular arcs and inwardly stepping down from the periphery of the pool 1. The bathing area 3 includes closely adjacent the intermediate shelf area 4 a circular guide stairs 7 with a guide handrail 8 and this guide stairs 7 consists of stairs which stepwise become deeper so as to have depths of 1.6 m, 2.0 m, 2.4 m and 2.8 m, respectively.

Reference numeral 35 designates an underwater tunnel curved downwardly and extending from the bottom of the intermediate shelf area 4 to a midway of the deepest area 5.

Although the present embodiment of the pool 1 is circular, the pool 1 may be of other shapes such as oval and rectangular shapes. Furthermore, the pool bottom may be formed so as to become deeper stepwise or continuously from the periphery to the center of the pool 1.

The large-sized concrete structure 2 accommodating said pool 1 is provided on a first basement 9 located around said deepest area 5 with a machinery room 29, a monitoring or watching room, an observation room etc., and on a first floor 10 located around the intermediate shelf area 4 and the bathing area 3 with an entrance 11 including a lobby at its innermost zone. A space defined laterally of said entrance 11 is divided into small compartments 13 used for an employee room, a restaurant, a tea room, an information corner, a reception office, a pro shop, a lecture room, etc. There are provided at the innermost zone of this first floor 10 a locker room 14, shower, sauna, toilet etc.

On a second floor 15 including the pool 1 itself, a relatively large pool side terrace 16 is maintained around said pool 1 at a corner of which there are provided a heated room 17, a pro shop 18, a stand 19, a medical room, a warehouse 20, an information board 21, etc.

A wellhole-like free space 24 extending through third and fourth floors 22, 23 above the pool 1, and floors defined laterally of this free space are provided with a restaurant/tea room 25, a fast-food shop 26, etc. The fourth floor 23 is partially utilized as an opendoor terrace 27.

Top of said wellhole-like free space 24 is covered with a transparent sunroof 28 facilitating the sunlight to be taken in therethrough.

Interior variation of such large-sized concrete structure 2 is not limited to the above-mentioned instance and may be modified in a wide range of variety.

On the bottom of said circular pool 1 at the deepest central area 5, a hollow tower 30 having a diameter in order of 3 m is constructed, into which persons can access from above by means of stairway or like and around which an artifical island 31 having a diameter in order of 10 m is formed at a level of the surface of the pool 1.

An air deck 32 is formed around the same tower 30 above said artificial island 31 at a level of the third floor 22 and connected by a connecting corridor 33 with said third floor 22.

Said tower 30 includes therein a watching or monitoring room 34 provided with a window to view the interior of the pool 1 or a diver observing room and further includes at the bottom of the tower 30 a projector 36 (underwater interface) adapted to project images into water.

Figure 11:
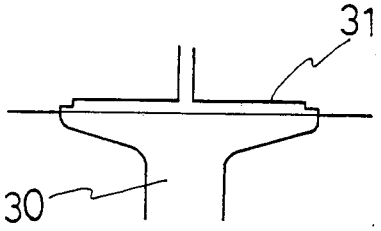
FIG. 11 is a front view showing an important part of the tower.

The artificial island 31 formed like a flange around the tower 30 integrally therewith has its underside tapered downwardly as shown by FIG. 11 and curved without any angular portion so that the divers may be protected against possible dangers.

The pool 1 maintains therein an extent within which an aritificial underwater space can be created by images projected from said projector 36.

It is also possible to define a playing area in which various playthings such as a seesaw can be installed.

Now a manner in which the diving pool of the invention is used will be described.

Users of the facilities provided by the present invention enter the structure 2 by the entrance 11 on the first floor 10, take predetermined proceedings at the reception office and borrow the implements necessary for scuba diving.

Then the users go through the locker room 14 and the shower room up to the second floor 15, and are now ready for diving, swimming or bathing in the pool 1.

The users having no intention to do diving may swim in the swimming area 3 and the beginning divers may enjoy diving in said swimming area 3 and the intermediate shelf area 4. In these areas, even the beginning divers can safely do diving without being seized with fear because these areas are provided with the shallows area 6 and the guide stairway 7 having the guide handrail 8.

The veteran divers may fully enjoy diving in the intermediate shelf area 4 and the deepest area 5. For example, these areas allow the divers to enjoy not only underwater athletics but also the images projected from the projector 36 together with background music. Thus the divers can experience an entirely new underwater amusement rather than merely diving, with a help of the scuba diving technique.

The divers can safely come and go through the tunnel 35 because this tunnel 35 is defined completely by curved surface only, i.e., has no angular portion.

Monitoring or watching for safety of the divers is efficiently achieved not only by a direct monitoring from the monitoring room 34 within the tower 30 and from the deck 32 but also indirectly by underwater monitoring TVs installed so as to have no dead angle.

The artificial island 31 can be utilized as a resting area for the swimming and the divers, and the deck 32 is also utilized for resting and admiration.

In the intervals of swimmings or divings, the users can play on the pool side terrace 16 and the roof terrace 27 and can take meals at the restaurant 25.

As will be apparent from the foregoing description, the diving pool of the invention, unlike the existing small-sized diving pools for basic training, permits the diving as a leisure to be easily and safely enjoyed in urbans and can create a new urban type resort.

When an air-bubble generator 39 forms an air-curtain 43 in water, this air-curtain 43 produces some turbidity and the divers can experience a nature somewhat similar to the underwater world as the divers pass through said air-curtain.

The air-bubble generator 39 may be installed, for example, as shown by FIG. 1, on the bottom of the intermediate shelf area 4 adjacent the deepest area 5 of the pool 1.

Figure 12:
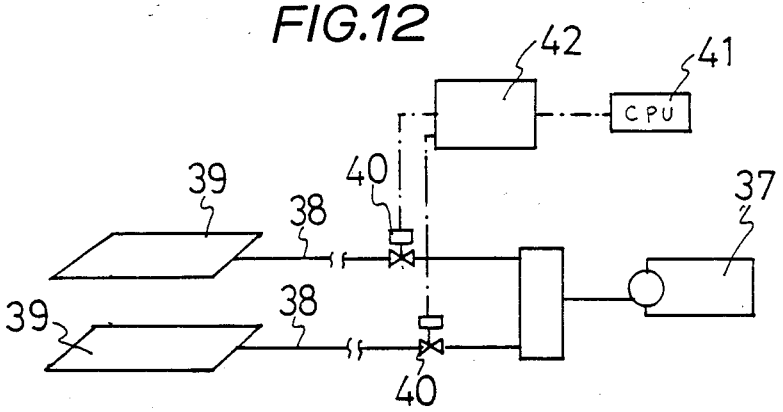
FIG. 12 is a diagram illustrating an air-bubble generator.

Details of the air-bubble generator 39 are shown by FIG. 12. The air-bubble generator 39 is supplied from a compressor 37 with compressed air through a valve 40 and an air pipe 38. An amount of the compressed air is regulated by a valve controller 42 through a computer 41. Said air-curtain 43 extends upwards to the pool surface and thereby suggests the divers that there is the deepest area 5 beyond the air-bubbles appearing on the pool surface even when the divers are swimming on the pool surface.

Figure 13:
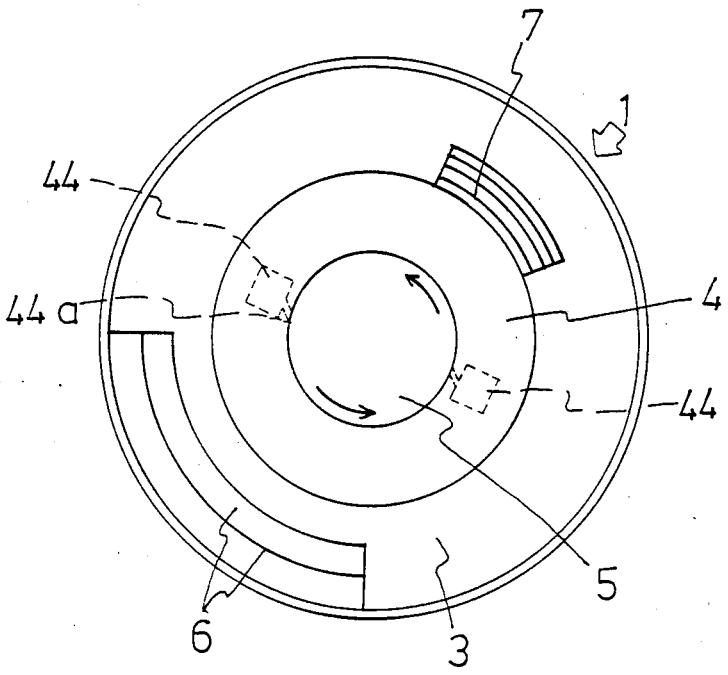
FIG. 13 is a plan view showing another embodiment of the diving pool constructed in accordance with the present invention.
Figure 14:
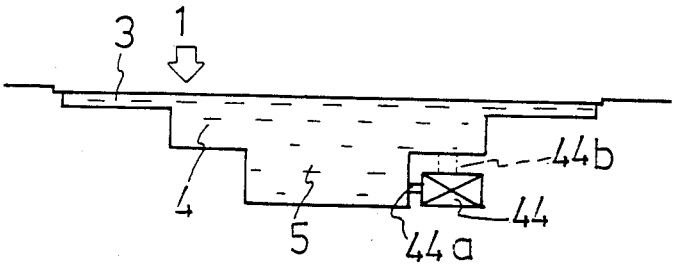
FIG. 14 is a schematic sectional view of said pool.

A water stream generator 44 may be provided to generate a water stream in the deepest area 5 of the pool 1. The water stream generator 44 may be installed, for example, as shown by FIGS. 13 and 14, with its outlet 44*a* opening laterally of the deepest area 5. An inlet 44*b* of the water stream generator 44 opens in the bottom of the intermediate shelf area 4 so that water is sucked through said inlet 44*b* into the water stream generator 44 and discharged therefrom through said outlet 44*a*, thus generating a water stream in the deepest area 5. The outlet 44*a* is directed circumferentially of the deepest area 5 so that a circumferential water stream is obtained. As a result, the divers can experience a water stream similar to a tidal current occurring in the sea and enjoy a nature just as encountered in the sea.

Figure 15:
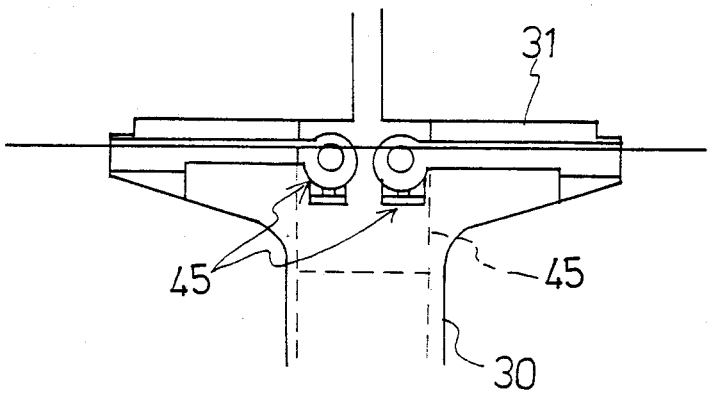
FIG. 15 is a front view illustrating how a wave generator is provided below an artificial island.

A wave generator 45 is preferably provided just below the artificial island, if desired to generate waves in the pool 1. For example, the wave generator 45 adapted to force water out by compressed air and thereby to generate waves is located just below the artificial island 31 as shown by FIG. 15.

Figure 16:
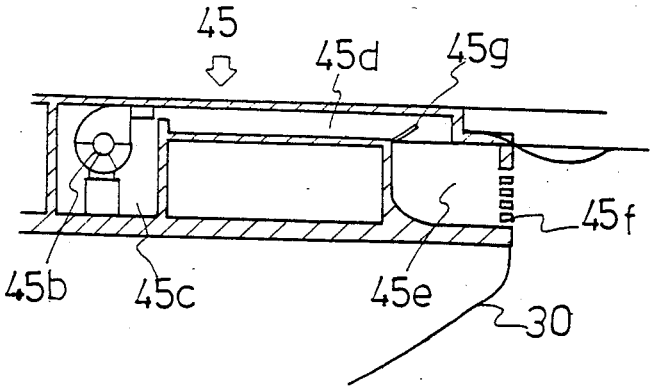
FIG. 16 is a sectional view illustrating more in detail how the wave generator is disposed.

Details of the wave generator 45 are shown in FIG. 16. Specifically, a blower 45*b* is installed within a air compressor chamber 45*c* which is, in turn, provided within the tower 30. The air compressor chamber 35*c* communicates through a duct 45*d* with an air-tight chamber 45*e*. Compressed air supplied from the blower 45*b* through the duct 45*d* and a damper 45*g* flows into the air-tight chamber 45*e*, increasing an air pressure within said air-tight chamber. In consequence, water is forced out from the air-tight chamber 45*e* through a protecting fence 45*f*, generating waves moving from the center towards the periphery of the pool 1.

What is claimed is:

1. A diving pool comprising:

a pool provided at substantially the center of a large concrete building;

a pool-side terrace provided at a pool side;

a free space provided above said pool, said free space being covered with a transparent sun-roof;

rooms for various purposes provided on floors above said pool-side terrace;

rooms for various purposes provided beneath said pool-side terrace;

a bottom of said pool provided such that said bottom gradually deepens from a peripheral area toward a center of said pool;

a tower provided at a deepest area of the center of said pool, said tower enclosing an area and having an inner and an outer wall and being provided with stairs in said area for people walking up and down and widows on said inner wall of said tower for looking into said pool;

an artificial island provided around said outer wall of said tower, said island being at a normal water level of said pool and being of such dimension to hold users of said pool thereon; and, a deck provided on said outer wall of said tower and above said water level, said deck having sufficient width for people to walk thereon.

2. A diving pool according to claim 1, further comprising an air-bubble generator provided at the bottom of said pool, said air-bubble generator for forming an air curtain in the water of said pool.

3. A diving pool as recited in claim 1, further comprising a water stream generator provided in the central deepest area of the pool to generate a water stream and a wave generator provided below the artificial island to generate waves in the pool.

4. A diving pool according to claim 1, further comprising an image projecting means provided at a lowest position of said tower, said image projecting means projecting images on a surface of a pool wall at the deepest area of the center of said pool.

* * * * *